United States Patent [19]

Walker

[11] 3,982,734

[45] Sept. 28, 1976

[54] IMPACT BARRIER AND RESTRAINT

[75] Inventor: Grant W. Walker, Sacramento, Calif.

[73] Assignee: Dynamics Research and Manufacturing, Inc., Sacramento, Calif.

[22] Filed: June 30, 1975

[21] Appl. No.: 591,277

[52] U.S. Cl. ..... 256/13.1

[51] Int. Cl.[2] ..... A01K 3/00

[58] Field of Search ..... 256/1, 13.1; 188/404, 188/1

[56] References Cited

UNITED STATES PATENTS

| | | | |
|---|---|---|---|
| 3,695,583 | 10/1972 | Walker et al. | 256/13.1 |
| 3,845,936 | 11/1974 | Boedecker | 256/13.1 |

*Primary Examiner*—Werner H. Schroeder
*Assistant Examiner*—Doris L. Troutman
*Attorney, Agent, or Firm*—Lothrop & West

[57] ABSTRACT

An impact barrier and restraint is provided for use on a longitudinally extending roadway. There are several barrier mechanisms, each including a base or diaphragm extending transversely of the roadway and related to the roadway by releasable anchors. In one version the diaphragm includes overlapping, transversely extending plates arranged to move transversely of the base. There are lateral buffer beams diverging and overlapping and secured to the diaphragms and to each other for telescoping movement. Between the diaphragms there are energy absorbing cells supported on the base and subject to disintegration upon impact of a vehicle or the like against the impact barrier, whether head-on or from the sides.

7 Claims, 11 Drawing Figures

FIG_1
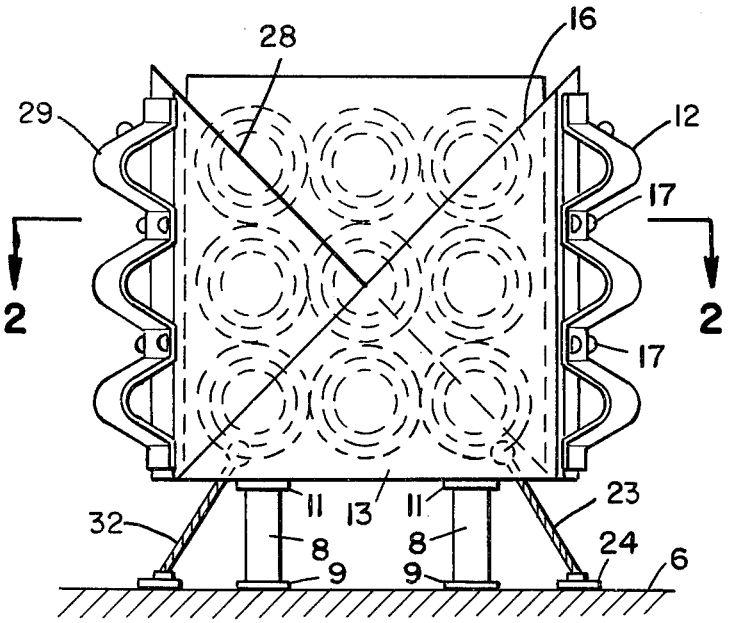
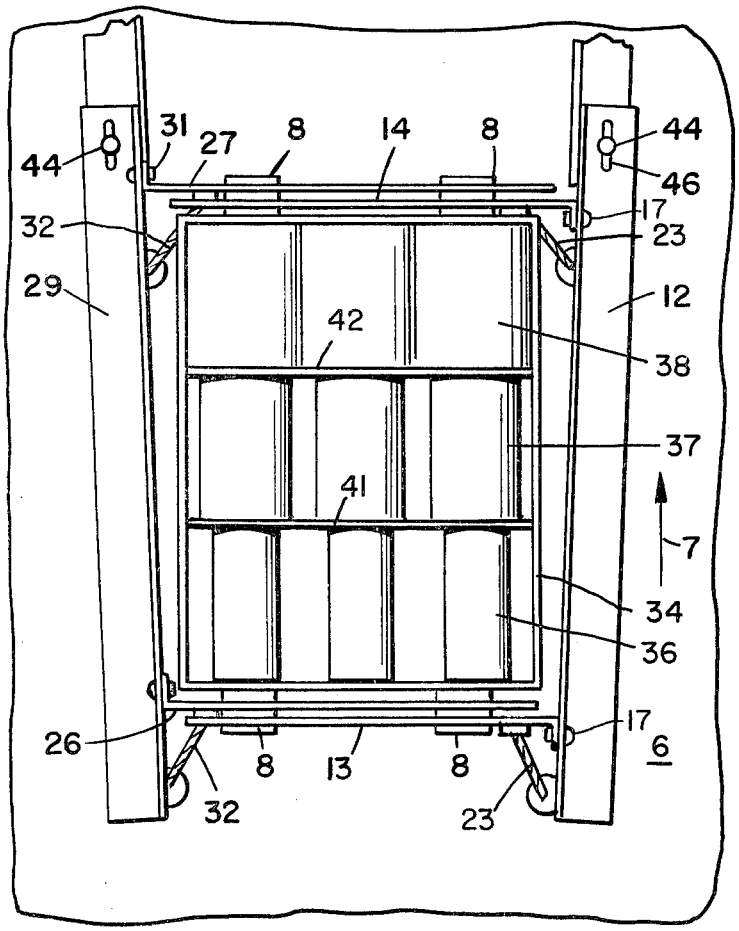
FIG_2
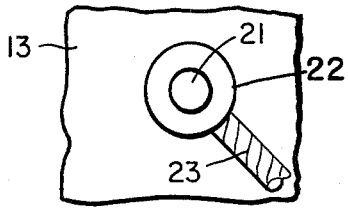
FIG_5
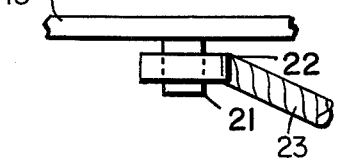
FIG_6
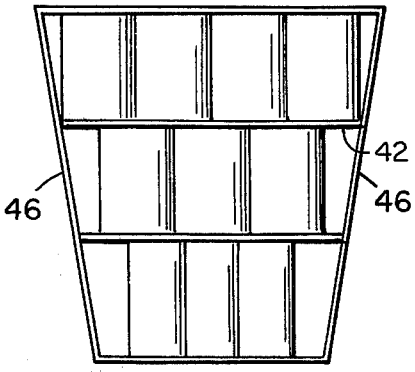
FIG_3
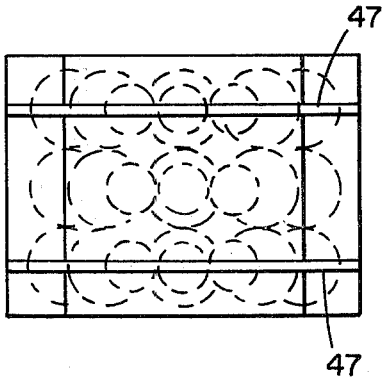
FIG_4

IMPACT BARRIER AND RESTRAINT

In Walker, Ford and Meinzer U.S. Pat. No. 3,666,055 issued May 30, 1972 for an energy absorbing device, there is disclosed a unit or cell comprised of a material such as a block of vermiculite arranged in a cylindrical form wrapped with helical wire and sometimes encased in a sack or bag. One or more of the cells are effective when positioned properly to receive an impact; for example, of a vehicle. The impact energy is transformed or dissipated by the disintegration of the vermiculite cell block. Many ways of utilizing such cells in connection with highway barriers and the like have been devised, tested and utilized. Many of the barriers are designed primarily for a head-on impact, whereas others are designed primarily for a lateral or side-glancing impact. There is need for such a device which can suitably withstand both head-on and lateral, glancing impacts. There is, furthermore, a requirement for such devices to use such cells that can readily be cleaned up and re-installed after an incident and can be easily repaired and promptly restored by relatively unskilled labor and very inexpensively.

It is therefore an object of the invention to provide an impact barrier and restraint useful in connection with energy absorbing cells of the sort mentioned and which can be utilized for head-on and lateral, glancing impacts, and which meets the requirements for installation, servicing, economy and the like.

Another object of the invention is to provide an impact barrier and restraint particularly useful in connection with lateral, glancing impacts.

A further object of the invention is to provide such an impact barrier and restraint which affords a unique, non-linear absorbing capability, particularly for head-on impact.

A further object of the invention is in general to provide an improved impact barrier and restraint.

Other objects, together with the foregoing, are attained in the embodiments of the invention described in the accompanying description and illustrated in the accompanying drawings, in which:

FIG. 1 is a view of one form of impact barrier and restraint constructed pursuant to the invention, the view being in a longitudinal sense from a roadway, portions being disclosed in transverse cross-section in a vertical plane;

FIG. 2 is a plan of the structure shown in FIG. 1;

FIG. 3 is a plan of a modified form of container and contents useful in connection with the remaining structure;

FIG. 4 is a front elevation of the container and contents as shown in FIG. 3;

FIG. 5 is a detail showing a portion of a restraining device in place;

FIG. 6 is a front elevation of the structure shown in FIG. 5;

Figure 7:
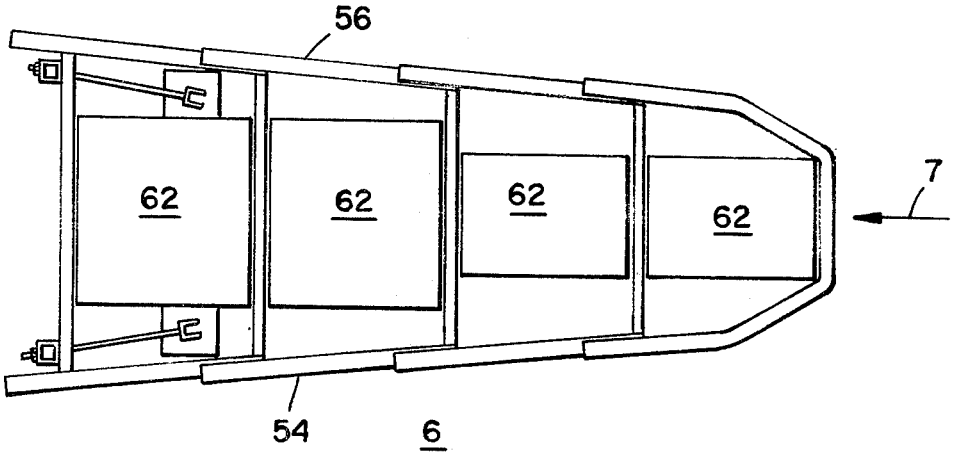
FIG. 7 is a diagrammatic plan of a modified form of impact barrier and restraint.

While the impact barrier and restraint pursuant to the invention can be embodied in various different ways, it has successfully been embodied and tested in the forms shown herein.

The device is particularly for use on a roadway, generally designated 6, in which one lane of traffic may travel in the direction of an arrow 7, for example. This is considered to be a longitudinal direction. The barrier may be erected in front of an abutment or the like or may simply be a longitudinally extending divider. The structure preferably has a base structure 8. In this instance, a number of upright pedestals form the base. Each pedestal has an enlarged foot 9 which can rest on the surface of the roadway and has a top pad 11 serving as a support. The base structure may include any number of the pedestals 8. In this instance there are four of them for each unit in the barrier. They are arranged side by side transversely of the roadway to provide a transverse base, and also one after the other along the length of the roadway to provide a longitudinal base.

At one side of the roadway, and preferably having a slightly divergent position, is a lateral buffer beam 12. This is conventionally a longitudinally corrugated metal member of substantial length. The buffer beam is related to the base support by means of a pair of transversely extending support plates such as 13 and 14. The plates are made of any relatively stiff, thin, light and inexpensive material. They can be metal or, in many instances, are readily fabricated of plywood or the like. Each of the plates 13 is of a generally triangular aspect, as shown in FIG. 1, and is arranged with the triangular hypotenuse 16 ranging from an upper point adjacent the buffer beam 12 at the top to a lower position away from the buffer beam and adjacent the support base 8. The buffer beams are at various points secured by fasteners 17 to the transversely extending support plates. Each of the transverse plates such as 13 and 14 rests upon two (or more) of the pads 11 so that the buffer beams are movable, except for other restraints, on the support elements 8. To make the unit generally stable, although transversely movable, some restraint is provided. The support plate 13, for example, has a longitudinally extending pin 21 firmly secured to the adjacent plate 13 and slidably receiving a surrounding ring 22 or washer. This is in turn secured to a cable 23 or chain going to a anchor 24 in the roadway 6. The cable or chain 23 preferably extends in a outwardly splayed, forwardly directed manner so that it lies intermediate a transverse direction and a longitudinal direction, generally extending more nearly longitudinally than transversely.

The structure as so far described is repeated in mirror symmetry on the other side of the mechanism, so that there is an impact absorption capacity in two lateral directions as well as head-on. Accordingly, there are additional support plates 26 and 27 of triangular shape having the hypotenuse 28 inclined downwardly and transversely as they recede from an additional buffer beam 29 arranged to diverge longitudinally and rearwardly from the buffer beam 12. The additional support plates 26 and 27, like their opposite plates, rest upon the top pads 11 of the pedestals or bases 8 and so are supported for transverse and longitudinal sliding thereon. The additional support plates 26 and 27 are similarly connected by means of fasteners 31 securing them to the additional buffer beams 29, so that these parts tend to move as a unit. They are positioned as firmly laterally and as freely longitudinally as are the support plates 13 and 14 and by a similar means.

Cables 32, like the cables or chains 23, extend from releasable fasteners such as 21 and 22 to appropriate anchors in the pavement. The upwardly extending anchor chains 23 and 32 are splayed inwardly and rearwardly, so that they tend to hold against transverse forces but tend to release readily against longitudinal forces having components in the direction of the arrow 7. In this fashion the plates 26 and 27 can move relative to the plates 13 and 14 in a transverse direction, one being able to move independently of the other in a transverse direction, but tending generally to move longitudinally as a unit.

To assist and augment the energy conversion or absorption capacity upon impact, there is preferably situated on the top pads 11 a container 34 of generally rectangular shape in plan. This usually comprises end walls and side walls but is without a bottom wall and, unless specially desired, without a covering wall. The container is readily fabricated of inexpensive, light material such as plywood panels appropriately secured together. The container tightly surrounds a number of energy cells 36, 37 and 38, as described in detail in the above-mentioned patent.

Preferably, the arrangement is such that the front cells 36, although of a standard length, are somewhat smaller in diameter than those cells 37 of a medium size arranged in the next rank, and considerably smaller than the cells 38 of large diameter in the final, rear rank. The arrangement of the cells in this order is so that the energy absorbed by the cells as they are demolished in the direction of the arrow 7 increases substantially. The momentum transfer from an on-coming vehicle in a head-on collision is thus relatively small in the beginning, increases as the barrier is crushed, and has a maximum transfer during the final crushing operation. While the cells are readily packed into the container and held by substantial friction between them and the surrounding walls, it is sometimes preferred to introduce separating diaphragms 41 and 42 between the rows of cells. These diaphragms assist in distributing the forces imposed upon the cells as they disintegrate. The cells can be varied in size and arrangement to get any selected pattern of energy conversion with distance of impact crushing.

As so far described, there is in effect on unit comprised of its supports, anchors, container, transverse support plates, diaphragms and buffer beams. A single arrangement of this sort is adequate in some installations, but in many others additional absorption capacity is required. Under those circumstances, it is preferably arranged to have duplicates, sometimes varying in size, disposed one behind the other. In such an instance, the additional material is likewise provided with its own buffer beams such as 12 and 29 arranged in train behind the beams 12 and 29 and secured thereto in a frictionally slidable fashion by fasteners 44 riding in longitudinal slots in the buffer beams. This allows some longitudinal movement of one structure with respect to its neighbor.

In a head-on impact, the entire mechanism is displaced in the direction of the arrow 7, but at a rate depending upon the progressive crushing of the cells 36, 37 and 38 and the breaking or deformation of the adjacent structures. The longitudinal movement is not impeded by the anchor chains since the rings 22 quickly release the pins 21. Virtually all of the crushing takes place without any restraint imposed on the structure by the anchors 24. This means that there is generally no disruption of the pavement by the impact. What usually occurs is that the container 34 may be shattered and the cells powdered. The debris falls onto the surface of the roadway 6. The buffer beams 12 and 29 may slide in the direction of the arrow 7 and may be mangled or distorted, but the roadway itself suffers no particular injury. In many instances, the parts can readily be replaced simply by hooking up the anchors 24 to additional containers and new cells. The buffer beams 12 and 29 can either be straightened or replaced. The amount of labor involved is very small, relatively, the clean-up operation can readily be conducted despite continuing traffic, and the cost per impact is relatively quite small.

In the event of an impact from the side, it is usually the case that an impacting vehicle travelling in the direction of the arrow 7 engages the buffer beam 12 at an angle not exceeding about 20° to the arrow 7. Such a blow is primarily a glancing blow and does little more than displace some of the mechanism transversely on the supports 8, as there is substantial restraint exercised in the transverse direction by the anchor chains 23. In many such instances it is merely necessary to move the parts back to their original location and perhaps to replace or straighten the impacted buffer beam 12 and any cells that may have been partly crushed. In a severe lateral impact, which is rare, the cells 36, 37 and 38 disintegrate, as before, and the clean-up and replacement job is substantially as previously described.

In the form of structure shown particularly in FIGS. 1 and 2, there is little divergence and overlap of the buffer beams. This mechanism is especially arranged for use as a central divider, which can take many of the transverse glancing blows, but can also take a head-on collision if such should occur. In other locations, the device may not be used primarily as a divider, but as a head-on protector for a upstanding abutment or the like. In the latter case, the same general arrangement is used, but, as shown particularly in FIGS. 3 and 4, the container 46 has its walls diverging much more markedly, as seen in plan. As a variation, the cells within the container can all be of the same diameter and length, but the ranks can simply vary in number and arrangement. This still attains the objective of a varied response to the transfer of momentum from the impacting vehicle. In this instance, the somewhat irregular cell arrangement can be accomplished easily by packing the cells into the enclosure somewhat loosely and then surrounding the enclosure 46 or container by metal straps 47 applied with considerable tension so that the contents of the container are in effect wedged or jammed into place as the container contracts.

The energy converting or absorbing mechanisms, as described, affords devices effective in head-on impacts as well as side or glancing impacats and , when encountered, result in debris that is not harmful in itself and can easily and quicklyd be cleaned up and replaced. The construction is inexpensive and simple and can be attended to with ordinary care and labor, so producing an improved technique.

In some instances, it is desired to have a relatively long installation with reasonable divergence and to arrange the buffer beams so that they are not unduly distorted by impact and can easily be serviced for reuse. This is accomplished in the form of device shown in FIGS. 7–11. In this arrangement the roadway 6 is as before with primary travel in the direction of the arrow 7. There is provided a base structure 51 including upright pedestals having feet 52 resting on and slidable on the surface of the roadway 6. Each transverse pair of pedestals is secured together by a transversely extending support plate 53 or diaphragm preferably not telescoping transversely and made up of a single, corrugated panel. The pedestal-panel diaphragm is secured to the roadway as previously described and illustrated.

The diaphragms are usually spaced apart at approximately equal intervals longitudinally but are of increasing width away from the leading point. The successive diaphragms are longitudinally related by slightly diverging, longitudinally extending buffer beams 54 and 56. These are corrugated plates fastened at their leading ends, primarily, to an adjacent diaphragm by nuts 57 on studs 58 welded to the panel 53. Each buffer beam is lapped over the successive buffer beam on that side of the barrier, and the beams are secured together for frictional sliding by bolts 59 fast in the underlapped beam and extending through extensive longitudinal slots 61 in the overlapping beam.

Between each pair of diaphgrams, energy absorbing units 62 are disposed, preferably resting on brackets 63 supported by the pedestals. These units are conveniently arranged and disposed as previously described.

Figure 8:
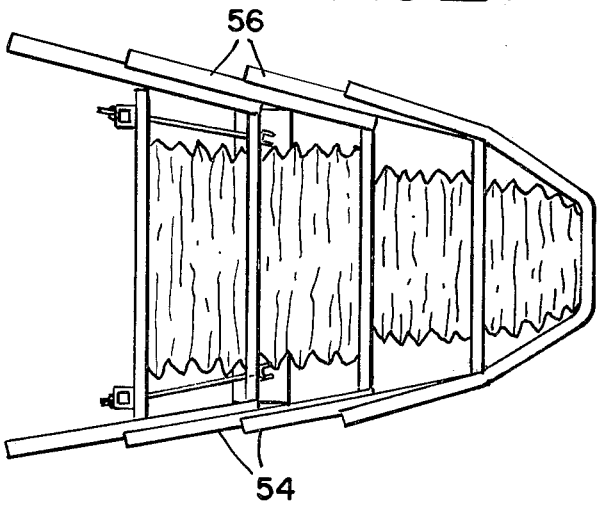
FIG. 8 is a diagrammatic plan of the device shown in FIG. 7 but in a telescoped condition.
Figure 11:
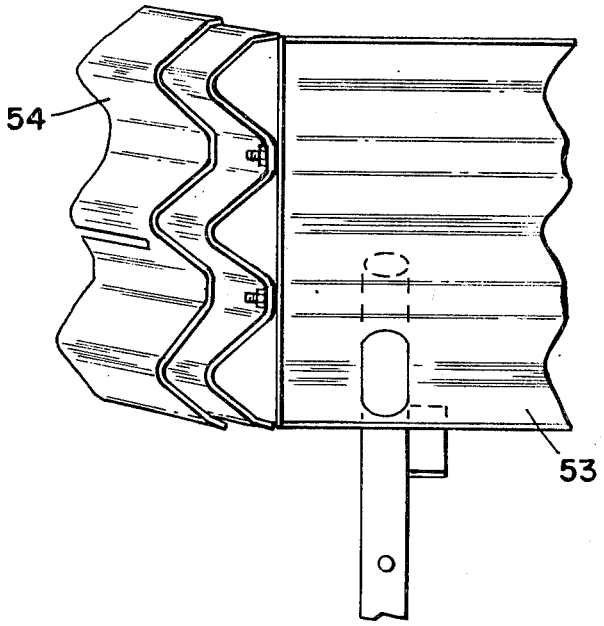
FIG. 11 is a cross-section approximately along the line 11—11 of FIG. 7, portions being broken away to reduce the size of the figure.
Figure 9:
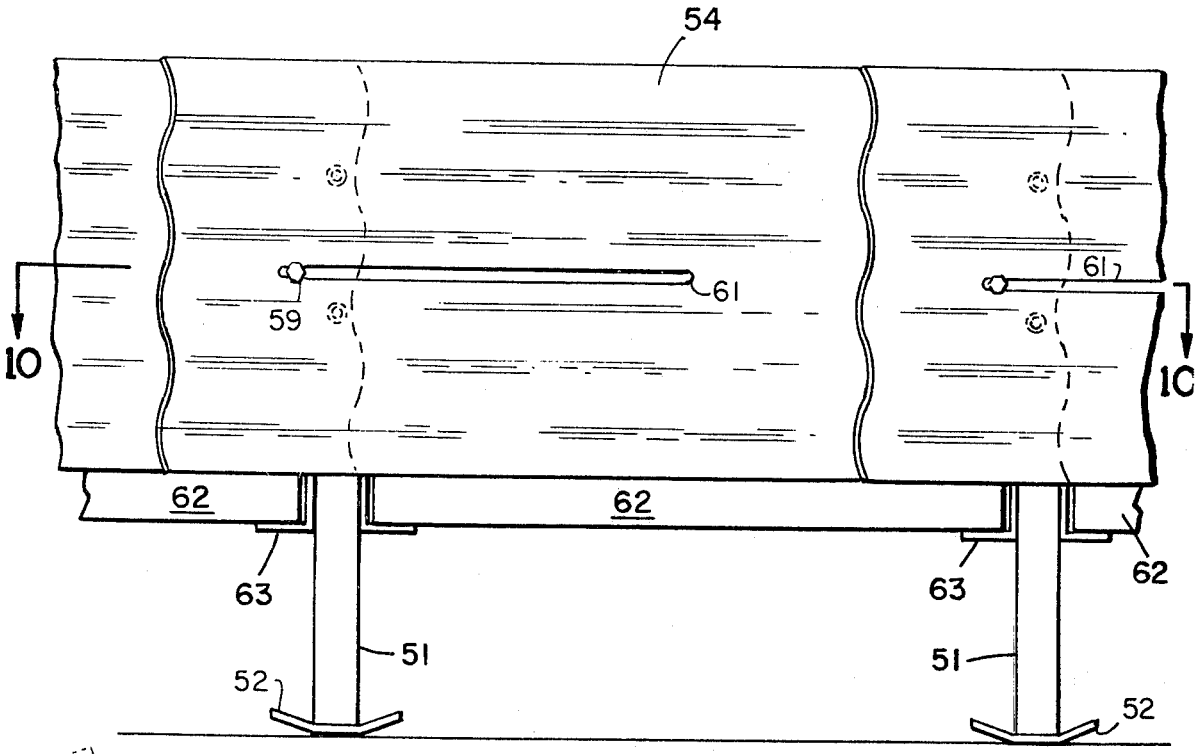
FIG. 9 is a side elevation of a portion of the structure shown in FIG. 7.
Figure 10:
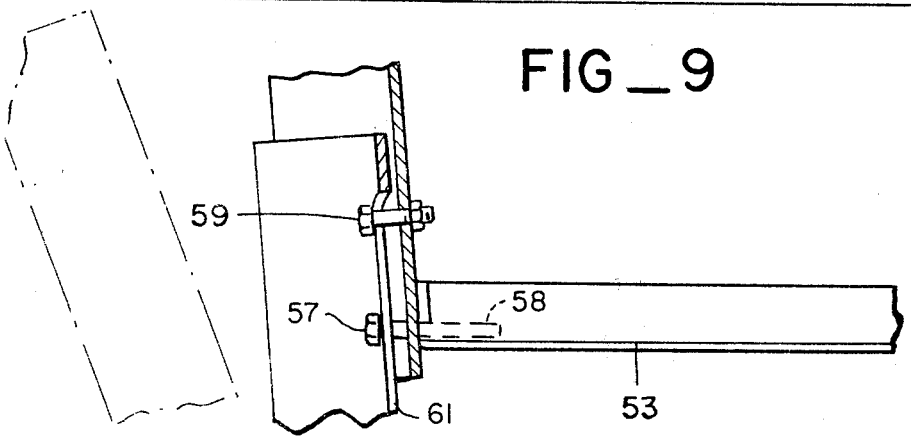
FIG. 10 is a cross-section approximately along the line 10–10 of FIG. 9.
Figure 10:
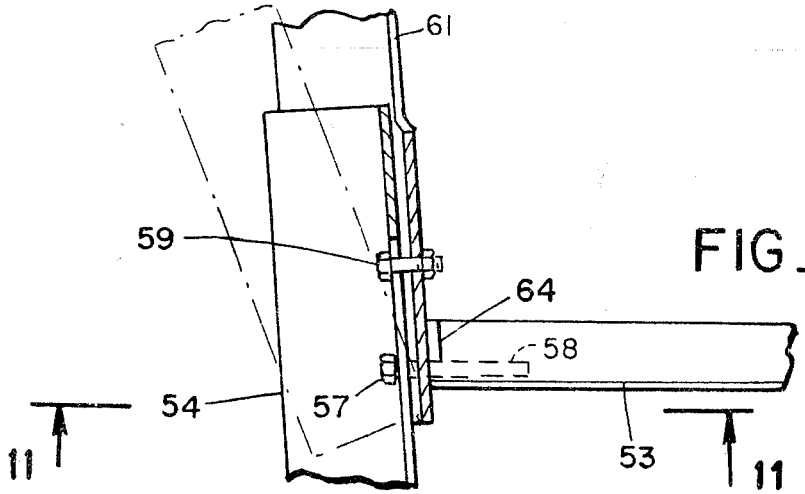

While in this arrangement there is no transverse telescoping or sliding of triangular members across each other, there is a greater and more orderly motion of the buffer beams, particularly in a head-on collision. The parts are initially related substantially as shown in FIG. 7, but during an impact are telescoped upon each other and may be disposed as shown in FIG. 8 at the end of impact. During a collision, the base supports slide on the roadway and the forward ones move toward the rearward ones as the intervening energy absorbing cells disintegrate.

Particularly, the buffer beams 54 and 56 are free to slide frictionally on each other to a large extent as the bolts 59 slide in the long slots 61. This tends to control the longitudinal motion of the buffer beams and to keep them generally to expected paths and positions. Additionally, the fasteners 57 and 59 are disposed substantially in the same vertical line which demarks a sort of hinge axis as the units telescope. As shown by dotted lines in FIG. 10, as the buffer beams travel rearwardly, they are in effect wedged apart. This might otherwise unduly distort them, resulting in scrap after but one use, but the vertically aligned (approximately) bolts 57 and 59 allow local bending partly around the side reinforcing straps 64 behind the panels 53 as fulcrums. Even after a severe impact, the buffer beams, although splayed substantially, are usually not distorted, except possibly in the immediate locality of the fasteners 57 and 59, and can easily be restored to position and recontoured, if necessary.

What is claimed is:

1. An impact barrier and restraint for use on a longitudinally extending roadway comprising means forming a plurality of pairs of bases, each pair being disposed transversely of said roadway and one pair being disposed behind the other, a first pair of transversely extending longitudinally spaced support plates, each support plate upstanding from a transverse pair of said base forming means, a first lateral buffer beam extending longitudinally of said roadway, means for stationarily fastening said first buffer beam to longitudinally spaced successive ones of said support plates, a second lateral buffer beam extending longitudinally of said roadway, means for stationarily fastening said second buffer beam to a second pair of longitudinally spaced successive ones of said support plates, means secured to said roadway for restraining transverse movement of said support plates on said base forming means, and energy absorbing means resting on said base forming means and disposed adjacent to said buffer beams and between successive support plates.

2. A device as in claim 1 in which said energy absorbing means includes a container, and a plurality of energy absorbing cells in said container arranged to increase in energy absorbing effect longitudinally from one end of said container to the other.

3. A device as in claim 1 in which said support plate is comprised of two transversely extending, overlapping triangular members transversely movable on said base means.

4. A device as in claim 3 including means for restraining transverse movement of said triangular members relative to said base means.

5. A device as in claim 1 in which said second pair of transversely extending support plates upstanding from and transversely movable on said base forming means is parallel to said first pair of support plates, and said second lateral buffer beam extends longitudinally of said roadway and diverges from said first buffer beam.

6. A device as in claim 5 in which said first pair of support plates and said second pair of support plates are separately connected to said restraining means.

7. A device as in claim 6 in which said restraining means are individually releasable from said different pairs of said support plates upon longitudinal motion of said support plates relative to said base forming means.

* * * * *